US006298699B1

(12) United States Patent
Gartner et al.

(10) Patent No.: US 6,298,699 B1
(45) **Date of Patent: *Oct. 9, 2001**

(54) ELECTRONIC INPUT AND DIAL ENTRY LOCK

(75) Inventors: Klaus W. Gartner, Verdes Estates, CA (US); Dieter Butterweck, Dortmund (DE); Peter J. Phillips, San Pedro, CA (US)

(73) Assignee: U-Code, Inc., Torrance, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/611,927

(22) Filed: Jul. 7, 2000

Related U.S. Application Data

(62) Division of application No. 08/627,799, filed on Mar. 29, 1996, now Pat. No. 6,116,066, which is a continuation of application No. 08/219,785, filed on Mar. 30, 1994, now abandoned.

(51) Int. Cl.[7] ..... E05B 49/00

(52) U.S. Cl. ..... 70/278.1; 70/133

(58) Field of Search ..... 292/347; 70/115, 70/119, 122, 126, 133, 138, 214, 220, 277, 278.1, 298

(56) References Cited

U.S. PATENT DOCUMENTS

| | | | | |
|---|---|---|---|---|
| 419,903 | | 1/1890 | Wilkins . | |
| 473,800 | | 4/1892 | Broek . | |
| 793,087 | * | 6/1905 | McVitty | 70/214 |
| 1,103,116 | | 7/1914 | Wehner . | |
| 1,179,099 | | 4/1916 | Hayashi . | |
| 1,270,372 | | 6/1918 | Breitather . | |
| 1,530,861 | | 3/1925 | Starden . | |
| 1,876,193 | * | 9/1932 | Wolters | 70/133 |
| 2,810,600 | * | 10/1957 | Kendrick | 292/357 |
| 3,023,601 | * | 3/1962 | Luikart | 70/297 |
| 3,099,150 | * | 7/1963 | Check | 70/133 |
| 3,447,347 | * | 6/1969 | Kawamura | 70/213 |
| 4,019,355 | * | 4/1977 | Germanton | 70/278 |
| 4,073,167 | * | 2/1978 | Bates | 70/133 |
| 4,114,408 | * | 9/1978 | Gee | 70/133 |
| 4,148,092 | * | 4/1979 | Martin | 70/149 |
| 4,220,022 | * | 9/1980 | Willach | 70/278 |
| 4,422,312 | * | 12/1983 | Chermoni | 70/133 |
| 4,457,148 | * | 7/1984 | Johainsson | 70/278 |
| 4,575,141 | * | 3/1986 | Burns | 292/336.3 |
| 4,627,250 | * | 12/1986 | Kim | 70/214 |
| 4,633,687 | | 1/1987 | Fane . | |
| 4,648,636 | | 3/1987 | Reynard . | |
| 4,665,727 | | 5/1987 | Uyeda . | |
| 4,669,394 | * | 6/1987 | Fogleman | 109/59 T |
| 4,727,301 | * | 2/1988 | Fulks | 70/278 |
| 4,736,970 | | 4/1988 | McGourty . | |

(List continued on next page.)

FOREIGN PATENT DOCUMENTS

| | | | | |
|---|---|---|---|---|
| 895629 | * | 3/1972 | (CA) | 70/351 |
| 4033008 | * | 12/1991 | (DK) | 70/278 |
| 2000217 | * | 4/1979 | (GB) | 70/278 |

*Primary Examiner*—Gary Estremsky

(57) ABSTRACT

An electronic combination lock having a dial-shape handle with a keypad incorporated therein is disclosed. Rotation of the handle extends or retracts a bolt that closes or opens the lock. The keypad includes indicia that give the user visual cues as to the orientation of the handle, thereby informing the user of the extended or retracted condition of the bolt. A battery pack is used to energize circuitry that recognizes a code entered through the keypad. The circuitry provides a control signal that activates a solenoid to extend or retract a bolt blocking device, which in turn prevents or enables movement of the bolt. A visual indicator warns of a low voltage or power condition in the battery pack. Electrical contacts are provided in the face plate of the handle to connect the circuitry to an external power source in case the battery pack fails.

33 Claims, 3 Drawing Sheets

U.S. PATENT DOCUMENTS

| | | | | |
|---|---|---|---|---|
| 4,745,784 | * | 5/1988 | Gartner | 70/133 |
| 4,748,833 | * | 6/1988 | Nagasawa | 70/214 |
| 4,754,625 | | 7/1988 | McGourty . | |
| 4,762,212 | | 8/1988 | Fish . | |
| 4,770,012 | | 9/1988 | Johansson . | |
| 4,799,371 | * | 1/1989 | Duncan | 70/214 |
| 4,831,851 | | 5/1989 | Larson . | |
| 4,838,052 | * | 6/1989 | Williams | 70/278 |
| 4,887,445 | * | 12/1989 | Beatty | 70/278 |
| 4,899,562 | * | 2/1990 | Gartner | 70/277 |
| 4,901,545 | * | 2/1990 | Bacon | 70/278 |
| 4,904,984 | | 2/1990 | Gartner et al. . | |
| 4,926,664 | * | 5/1990 | Gartner | 70/119 |
| 4,956,985 | | 9/1990 | Kim . | |
| 4,967,577 | | 11/1990 | Gartner et al. . | |
| 5,033,282 | * | 7/1991 | Gartner | 70/119 |
| 5,058,404 | * | 10/1991 | Fish | 70/278 |
| 5,061,923 | | 10/1991 | Miller . | |
| 5,133,265 | * | 7/1992 | Lahti | 70/432 |
| 5,136,870 | * | 8/1992 | Gartner | 70/277 |
| 5,437,174 | | 8/1995 | Aydin . | |
| 5,473,922 | * | 12/1995 | Bair | 292/144 |
| 5,605,066 | * | 2/1997 | Hurskainen | 70/278 |
| 5,638,708 | * | 6/1997 | Hsu | 70/213 |
| 6,116,066 | * | 9/2000 | Gartner | 70/278 |

* cited by examiner

*FIGURE 3*
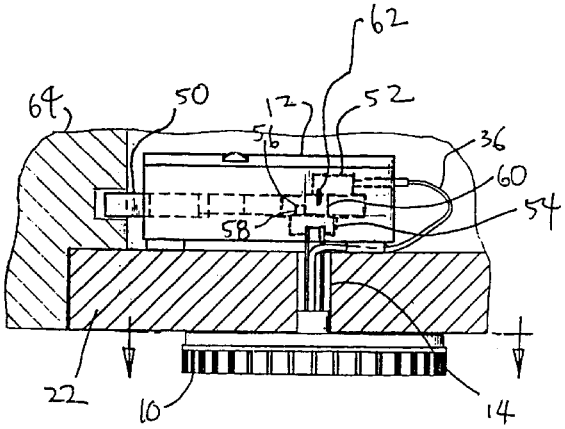
*FIGURE 4*
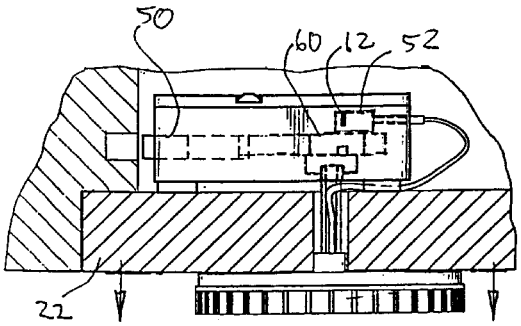
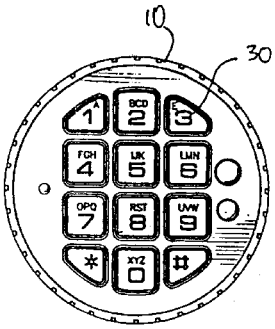
*FIGURE 5*
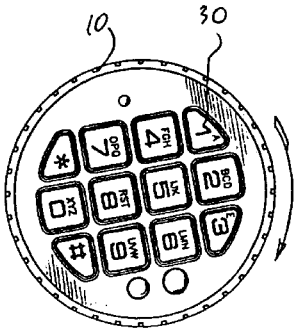
*FIGURE 6*

ELECTRONIC INPUT AND DIAL ENTRY LOCK

CROSS-REFERENCE TO RELATED APPLICATIONS

This application is a divisional of U.S. patent application Ser. No. 08/627,799, now U.S. Pat. No. 6,116,066 filed Mar. 29, 1996, which is a file wrapper continuation application of U.S. patent application Ser. No. 08/219,785, filed Mar. 30, 1994, now abandoned, which are all herein incorporated by reference.

BACKGROUND OF THE INVENTION

1. Field of the Invention

The present invention relates to combination locks. More precisely, the present invention relates to an electronic push button lock, wherein the push buttons have indicia and mare located on the lock handle, and the open or closed condition of the lock is indicated by the orientation of the indicia on the handle.

2. Prior Art and Related Information

Electronic locks have gained wide popularity for several reasons. First, it is usually less expensive to fabricate the electronics necessary to decipher an open combination than it is to machine and assemble mechanical parts to perform the same function. Second, the material and labor costs involved in manufacturing an electronic lock tend to be lower as compared to a completely mechanical combination lock.

Third, an electronic lock is sometimes superior to a mechanical lock in defeating a potential safe cracker. For example, it is sometimes possible to manipulate a mechanical combination lock by relying on sounds generated by the moving tumblers inside, thereby obtaining the correct combination through sounds. On the other hand, an electronic lock deciphers the dial-in combination without moving parts and therefore does not serve as a feedback mechanism to assist the safecracker in breaching the lock.

Fourth, electronic locks are popular in that they can be easily reprogrammed to change the combination when necessary. The reprogramming is easy to accomplish electronically perhaps with only a few keypunches. In contrast, a mechanical door lock requires disassembly of certain portions of the lock cylinder. In a hotel room setting, an electronic lock that is easily reprogrammed is significantly more advantageous than a key lock, for instance, because the former can be reprogrammed if the key to the lock is lost or stolen.

There are many variations of electronic locks in the art. For example, U.S. Pat. No. 4,665,727 to Uyeda discloses an electronic digital safe lock including a slide plate pivotally connected by an articulated linkage to a bolt operating lever for retracting the safe door locking bolts after digital input of the electronic lock combination. The invention of Uyeda further includes a mechanical bypass system wherein a manual combination lock can be manipulated to release the locked bolt, U.S. Pat. No. 4,745,784 to Gartner discloses an electronic dial combination lock having a spindle journalled within the lock for movement within two degrees of freedom; i.e., rotational and axial displacement to cause engagement of a push pin located on an internal cam wheel to engage one of a plurality of pressure-sensitive switches within the lock. Each switch is capable of making a discrete electrical connection. Circuitry is included to detect when a predetermined, sequential order corresponding to the lock's combination is input through the pressure-sensitive switches. Gartner replaces conventional combination locks which typically comprise a plurality of tumbler wheels coaxially journalled on a rotating spindle which projects outwardly from the lock and is manipulated within one degree of freedom (rotational) through a predetermined, sequential series of rotations to operate a bolt within the lock.

U.S. Pat. No. 4,831,851 to Larson discloses a lock mechanism having a mechanical combination lock and an electronic lock, wherein the mechanical combination lock serves as a fail safe entry in case of failure of the electronic lock. In that same vein, U.S. Pat. No. 4,967,577 to Gartner et al. discloses an electronic lock with a manual combination override for opening of a lock by both an electronic and manual means. A variation of an electronic door lock is provided in U.S. Pat. No. 4,899,562 to Gartner et al., wherein a single control knob is used for entering a predetermined combination through manipulation of the knob in a first arc of rotation, the code being entered by pushing the dial inwardly to bring a push pad into contact with individual switches in an array of electrical switches provided on a printed circuit board within the lock housing. The release of the door locking bolt is accomplished after entry of the predetermined code by further manipulation of the control knob through remaining portions of the knob rotations which were unavailable until after entry of the predetermined code. An alternative manner of entering the code for the electronic lock is provided through digital input pads located on the escutcheon.

In electronic locks, generally, the bolt or latch is mechanically operated. The electronic portion of the lock controls a solenoid which blocks or unblocks movement of the bolt thereby permitting the bolt to be respectively disabled or operated.

An example of one such solenoid-operated lock is U.S. Pat. No. 4,904,984 to Gartner et al. The patent teaches a combination lock with an additional security lock wherein an electrically operable solenoid, having an armature post normally biased outward of a solenoid body, is mounted to the combination lock housing so as to position the armature post normally to block movement of either the combination lock bolt or the bolt release lever associated with the bolt. An electrical signal generator is used to selectively operate the solenoid to retract the post from a bolt and/or bolt release lever blocking position to allow operation of the combination lock.

An electronic lock has its limitations. In a typical keypad code entry electronic lock, for example, it is often difficult by sight to determine if the locking bolt is in the retracted or extended position. Because the dial in prior art mechanical locks are often replaced by a digital keypad, there are no visual indications as to the locked or unlocked condition of the lock. Thus, someone who is distracted or absent-minded might easily leave the electronic lock in the open position; conversely, the electronic lock might be locked accidentally because the user was not aware of its locked condition based solely on any visual cues.

Therefore, a need presently exists for an electronic keypad operated combination lock wherein the keypad is merged into the handle. By virtue of the indicia on the keypad, it is possible to instantly recognize the open or closed condition of the lock based on the orientation of the indicia.

SUMMARY OF THE INVENTION

In view of the foregoing, it is therefore an object of the present invention to provide an electronic combination lock having a keypad with push buttons bearing indicia that indicate an open or closed condition of the lock. It is another object of the present invention to provide an electronic combination lock wherein the digital keypad is incorporated into the handle that operates the bolt. It is still yet another object of the present invention to provide an electronic combination lock having a housing that attaches through unidirectional rotation onto bolts on a door to which the lock is to be mounted. It is still another object Of the present invention to provide a handle having a dial shape and incorporating a manual keypad therein, which handle when rotated retracts the locking bolt. It is yet another object of the present invention to provide an electronic lock having a power level indicator, and backup electrical contacts for connection to an outside power source in case of a power failure of the internal power source.

To achieve the foregoing objects, the present invention in a preferred embodiment provides a combination lock for mounting on a door comprising a handle having a keypad with keys, bearing indicia, for entering a code, wherein the handle is attached to a shaft rotated by the handle. A bolt having an extended position and a retracted position is selectively operated by rotation of the handle, whereby an orientation of the indicia selectively indicates the extended position and retracted position of the bolt. An electromagnetically operated bolt blocking device selectively blocks and unblocks movement of the bolt, while a controller receives the entered code from the keypad and provides a control signal, wherein the control signal triggers the bolt blocking device to unblock the bolt, and movement of the bolt is consequently enabled so that rotation of the handle moves the bolt to the retracted position.

The preferred embodiment of the present invention electronic combination lock is powered by a battery. The dial face includes electrical contacts that allow for connection to an outside electrical source in case the internal battery fails. As a safety precaution, the present invention preferably includes a battery power indicator located on the dial face to warn of a drained power supply.

In prior art devices, the electronic keypad is immobile. Furthermore, in conventional electronic locks, the keypad is separate from the handle used to operate the locking bolt. The present invention therefore provides a unique and clever electronic lock wherein the keypad for entering an open code also serves as an indicator of the open or closed condition of the lock. The dial-like structure surrounding the keypad further serves as a handle to open and close the lock bolt.

BRIEF DESCRIPTION OF THE DRAWINGS

The objects, features and advantages of the present invention will be apparent to one skilled in the art from reading the following detailed description in which:

FIG. 3 and FIG. 4 are partial sectional views of the present invention combination lock installed on a door, showing the bolt in its extended and retracted positions, respectively.

FIG. 5 and FIG. 6 are front views of the dial indicating a closed state and an open state of the lock, respectively.

DETAILED DESCRIPTION OF THE INVENTION

The following specification describes an electronic lock with a digital keypad incorporated into the handle. In the description, specific materials and configurations are set forth in order to provide a more complete understanding of the present invention. But it is understood by those skilled in the art that the present invention can be practiced without those specific details. In some instances, well-known elements are not described precisely so as not to obscure the invention. The present invention relates to an electronic combination lock disposed on a door comprising a handle having a keypad with keys bearing indicia for entering a combination code, a shaft rotated by the handle mounted to the door, and a bolt having an extended position and a retracted position, selectively operated by rotation of the handle whereby an orientation of the indicia selectively indicates the extended position or retracted position of the bolt. An electromagnetically operated bolt blocking device is used to selectively block and unblock movement of the bolt based on a controller receiving the proper code entered from the keypad. Specifically, upon receipt of the proper code, the controller provides a control signal that triggers the bolt blocking device to unblock the bolt, thereby enabling movement of the bolt by rotation of the handle to displace the bolt to the retracted position.

Figure 1:
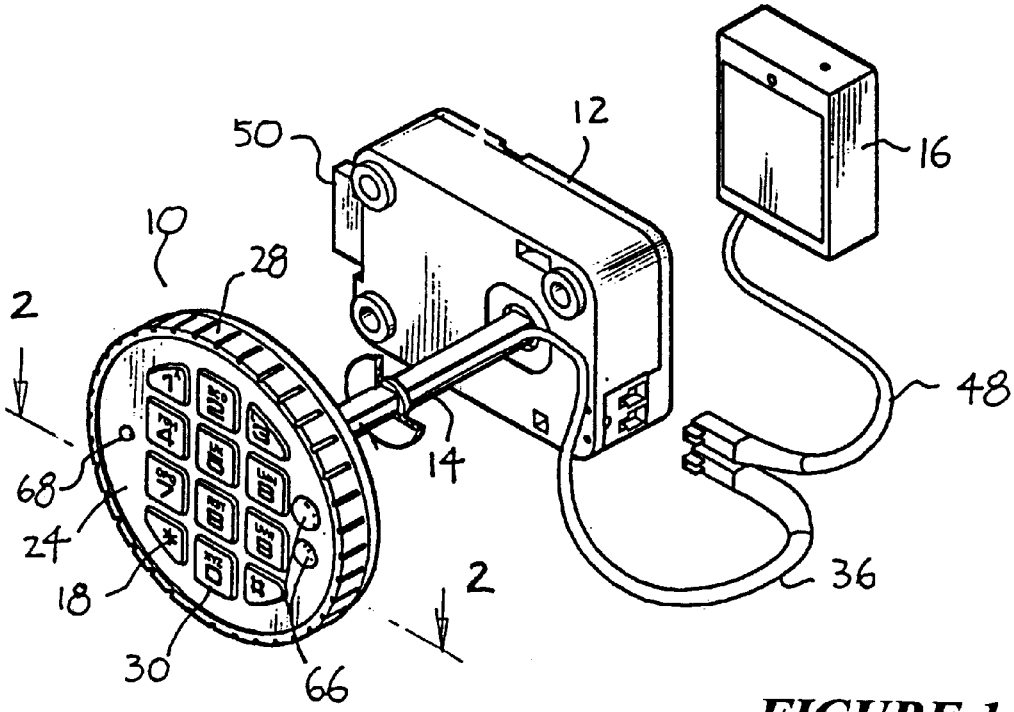
FIG. 1 is a perspective view of the present invention electronic combination lock showing a dial shape handle having a digital keypad incorporated therein, said handle connected to a shaft to operate a lock, and the lock being powered by a battery pack.

FIG. 1 shows a preferred embodiment of the present invention electronic lock. In the preferred embodiment, the electronic lock has preferably three major components including a handle 10 connected to a lock 12 through a shaft 14, powered by a battery pack 16 containing a DC cell.

In the preferred embodiment, the handle 10 is fashioned into a round dial shape with ridges 28 around the circumference. Incorporated into the face plate 24 of the handle 10 is a keypad comprised of individual push buttons 18. Each push button 18 optionally bears indicia 30 such as numbers, letters, symbols, and like alpha-numeric representations.

For the present invention electronic combination lock, the push buttons 18 are used to enter a preset combination code to open the lock. In addition, as discussed in detail below, the orientation of the indicia 30 gives the user an indication of the open or closed condition of the lock. To that end, in an alternative embodiment, the individual keys may be formed into unique shapes that give the user a frame of reference without need for imprinted or embossed indicia.

Figure 2:
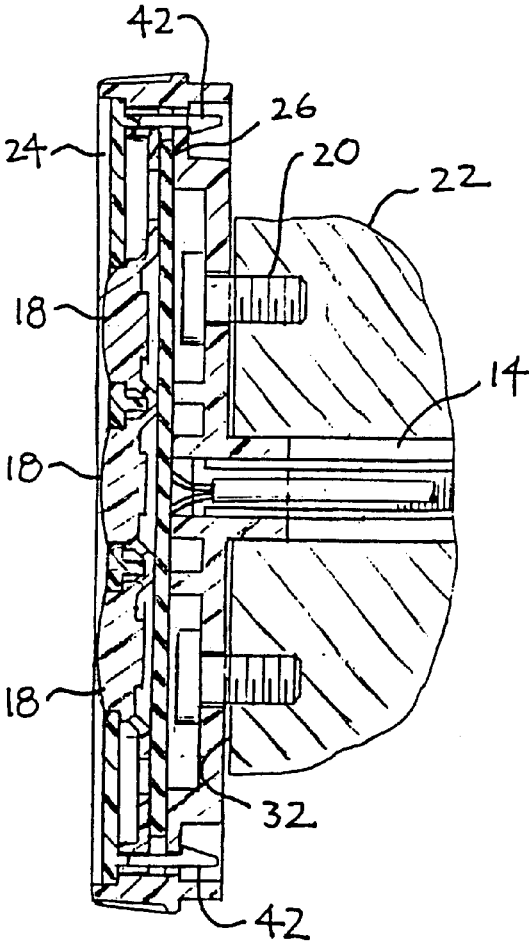
FIG. 2 is a cross-sectional view of the dial-shape handle shown in FIG. 1 taken along line 2—2.

As partially illustrated in FIG. 2, the handle 10 is mounted on an exterior 32 of a door 22 while the lock 12 and battery pack 16 are preferably located on the interior side of the door 22. Being on the interior side of the door protects the hardware from unauthorized tampering.

The present invention is useful in a variety of applications. Therefore, the door 22 may be part of a safe, a hotel room door, a locker door, a security gate, a lock box, a vault door, a front door of a residence, etc.

As mentioned above, the handle 10 is connected to the lock 12 through a shaft 14 which includes an optional channel 34 extending the length thereof. As seen in FIG. 2, the channel 34 is needed so that the electrical cable 36 interconnecting the circuitry in the handle 10 to the lock 12 can be protected from torsional forces when the handle 10 and the shaft 14 are rotated.

Figures 7, 8, 9:
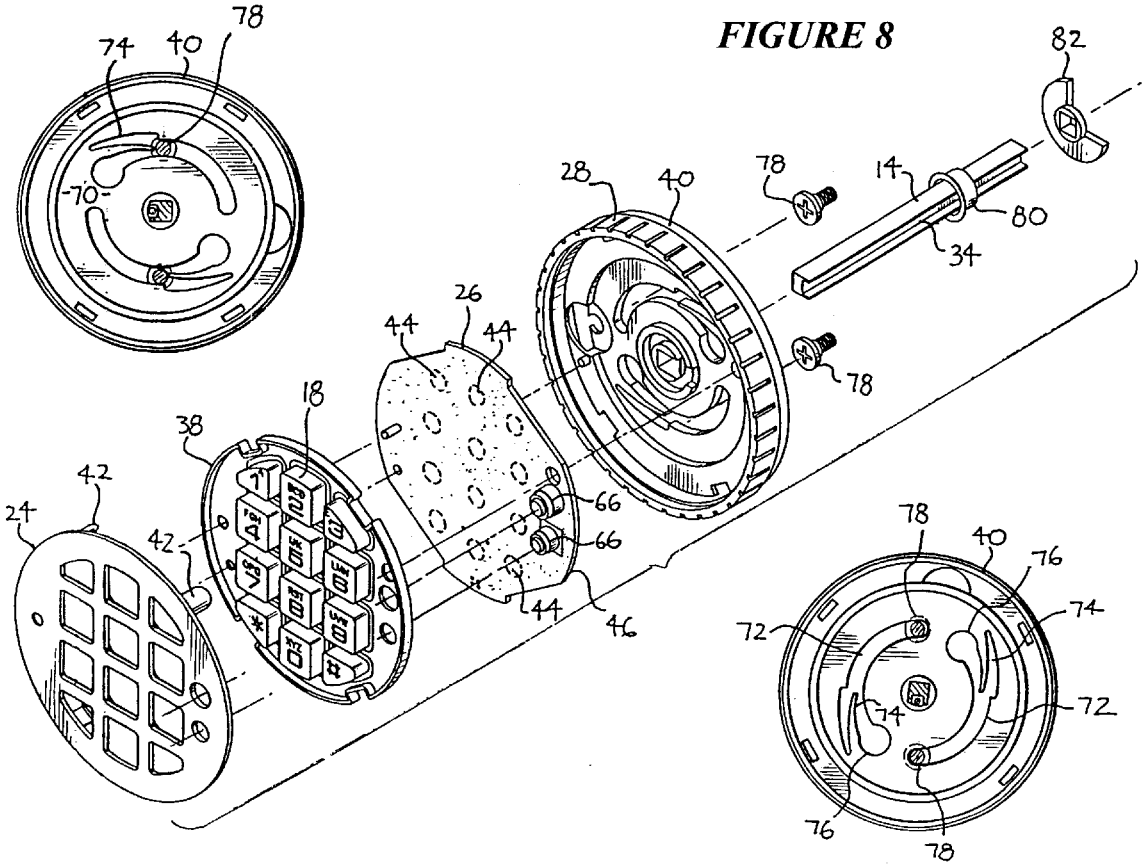
FIG. 7 is a front view of the dial housing showing two curved mounting slots, wherein each slot includes a cantilevered finger biased to extend into the curved slot.
FIG. 8 is an exploded perspective view of the dial shape handle assembly and shaft.
FIG. 9 is another view of the dial housing shown in FIG. 7, wherein the dial housing has been rotated counterclockwise 90 degrees.

FIG. 8 illustrates the major components of the handle 1 0, including a face plate 24, the keypad 38 with push buttons 18, a printed circuit board 26, and a round, dial-shape housing 40. In this exemplary embodiment, the foregoing parts are snapped together using snap-on hooks 42 as best illustrated in FIGS. 8 and 2. On the other hand, other fastening means for assembling the major components together known in the art, such as screws or cement, can be used as well.

The keypad 38 includes individual push buttons 18 that when depressed by a finger actuate contact switches 44, preferably located beneath a membrane 46. The contact switches 44 are disposed on the printed circuit board 26, which carries the electronics for the lock. Power for the printed circuit board 26 is preferably supplied by the battery pack 16 via cables 48 and 36. The membrane covered contact switches 44 are of a type generally known in the art.

In the present exemplary embodiment, the contact switches 44 comprise mechanical switches including a movable spring arm contact positioned over a stationary contact. The pressure sensitive switches 44 are used to complete an electrical circuit provided in a known manner on the printed circuit board 26.

The printed circuit board 26 includes circuitry known in the art for sensing electrical connections completed by depressing the contact switches 44, and detecting when a given series of connections have been made in a predetermined, sequential order corresponding to a code or combination for the lock. Once this occurs, the printed circuit board 26 generates an electrical control signal, such as a square wave, spike, or ramp, to operate the lock. In an alternative embodiment, the printed circuit board may carry a sophisticated microprocessor with a nonvolatile random access memory, known in the art, if a more complex, user programmable combination scheme is desired.

As best seen in FIGS. 3 and 4, the control signal is conveyed via cable 36 to a solenoid 52 located inside the lock 12. Within the solenoid 52 is preferably an electromagnetically operated bolt blocking device 62 that moves into a blocked or unblocked position based on whether an inductor in the solenoid 52 is energized or not. The principle behind the solenoid is well-known and need not be explained further here.

Importantly, the blocked and unblocked positions of the bolt blocking device 62 disable or enable movement of a locking bolt 50. In the preferred embodiment, the lock 12 includes the bolt 50 operated by rotation of the handle 10 and the shaft 14. As shown in FIGS. 3 and 4, the end of the shaft 14 includes a wheel 54 having an outward extending pin 56. The pin 56 glide; along a straight slot 58 formed into a translational element 60.

Thus, when the handle 10 rotates the shaft 14, the wheel 54 rotates the pin 56 in an arcuate path. In turn, the pin 56 slides along the slot 58 while simultaneously forcing the translational element 60 to move laterally, as shown in the top views of FIG. 3 and 4, to the left or right depending on the direction of rotation of the wheel 54. Still in the top view of FIGS. 3 and 4, the foregoing occurs because while the pin 56 is displaced through an arcuate path by rotation of the wheel 54, it is simultaneously moving freely vertically along the slot 58, but engages the translational element 60 in the horizontal component of its path. Thus, the horizontal component of the motion of the pin 56 is transferred to the translational element 60, causing the latter to move laterally.

In other words, the translational element 60 converts the rotational motion of the handle 10 and shaft 14 to a lateral, translational motion. The lateral motion of the translational element 60 causes the bolt 50, which is connected thereto, to either extend out or retract back into the lock 12, as shown in FIGS. 3 and 4, respectively.

Based on whether or not the solenoid 52 is energized, the bolt blocking device 62 selectively engages or disengages from the translational element 60. Preferably, as shown in FIG. 3, the bolt blocking device 62, which may be a spring-loaded, electromagnetic pin, engages the translational element 60 thereby preventing its lateral movement, even under torque from the shaft 14 and handle 10. Under these conditions, the bolt 50 is extended into the door frame 64 and the door 22 is effectively locked.

On the other hand, when the printed circuit board 26 generates the control signal after the proper code is entered, the solenoid 52 is energized, thereby disengaging the bolt blocking device 62 from the translational element 60. This condition is shown in FIG. 4. At this instant, the translational element 60 is free to move laterally and any rotation of the handle 10 and associated shaft 14 extends of retracts the bolt 50. FIG. 4 3hows the bolt 50 retracted into the lock 12, thus permitting the door 22 to be opened. Of course, the foregoing only describes a preferred embodiment; there are numerous other mechanisms known in the art to accomplish the same blocking and unblocking of the bolt.

Under power-off, standby conditions, the spring-loaded bolt blocking device 62 is preferably biased to engage the translational element 60 thereby maintaining the bolt 50 in the locked position, as shown in FIG. 3. Assuming the battery pack 16 has drained and no power is available, the present invention also features an optional pair of polarized contacts 66, located in the face plate 24. These contacts 66 are connected to the printed circuit board 26 and wired to the solenoid 52. Accordingly, even if the battery pack 16 is drained, under emergency conditions, a power source can be connected to the polarized contacts 66 to energize the electronics so that the proper code can be entered to retract the bolt 50 to unlock the door 22. The external power source can be a generator terminal or a simple nine-volt battery which has two terminals that conveniently mate with the polarized contacts 66.

The present invention combination lock further includes an optional power level indicator 68, nestled in the face plate 24. The power level indicator 68 may be a light emitting diode (LED), a liquid crystal display (LCD), or a like low power consumption device that indicates the voltage level of the battery pack 16. Through circuitry known in the art, when the battery pack 16 voltage drops below a threshold level, the power level indicator 68 can be illuminated. This would inform the user that the battery pack 16 should be replaced with fresh cells.

FIGS. 7, 8 and 9 provide various views of the handle housing 40. Notably, the back 70 of the housing 40 preferably includes two curved mounting slots 72, which facilitate assembly of the housing 40 to the door 22. Each curved mounting slot 72 further includes a resilient, cantilevered finger 74 that projects inward into the slot 72. At an end of each mounting slot 72 is a large opening 76 through which the head of a mounting screw 78 may an pass. So during initial assembly of the housing 40 to the door 22, the screw head passes through the opening 76, and the housing 40 is then rotated. This changes the position of the curved mounting slot 72 relative to the immobile mounting screw 78. The mounting screw essentially translates along the slot 72.

In FIG. 7, when the housing 40 is rotated counterclockwise,the mounting screw 78 is translated passed the cantilevered finger 74, at which point the spring back in the cantilevered finger 74 biases the finger 74 inward toward the interior of the slot 72. This prevents the mounting screw 78 from translating along the slot 72 in the reverse direction. As a result, the housing 40 as shown in FIG. 7 cannot be rotated any farther in the clockwise direction because the cantilevered finger 74 has engaged the mounting screw 78. Conversely, the housing 40 can be rotated in the counterclockwise direction, simultaneously causing the mounting screw 78 to slide along the curved mounting slot 72.

Once the mounting screws 78 have translated past the cantilevered fingers 74, they are free to glide along the curved slot 72 and cannot slide back into the large openings 76. Once the housing 40 is assembled to the screws 78, the housing 40 cannot be disassembled by passing the screw head through the same openings 76.

Importantly, it is the rotation of the housing 40 that moves the shaft 14 which ultimately extends or retracts the bolt 50. The curved mounting slots 72 therefore permit easy assembly to the door but inhibits disassembly therefrom, while allowing the housing 40 to still rotate after assembly. A collar 80 positioned on the shaft 14 when mated to a lock washer 82 keeps the shaft 14 from being pulled out or pushed inward along its rotational axis.

As best seen in FIGS. 5 and 6, the handle 10 includes indicia 30 positioned on the push buttons 18. When the handle 10 rotates, the indicia 30 rotate. Using the orientation of the indicia 30 as a visual cue, it is thus possible for the user to immediately recognize the open condition or closed condition of the bolt 50.

For example, when the handle 10 is in its upright state with the indicia 30 in their upright position, the bolt 50 is in its extended position as shown in FIG. 3. On the other hand, when the handle 10 is rotated clockwise, the indicia 30 assume a different orientation thus informing the user that the bolt 50 has been retracted.

What is claimed is:

1. A method of operating a combination lock mounted to a closure member, the method comprising:

mounting the combination lock to the closure member, wherein the closure member has a planar, exterior-facing surface and a planar, interior-facing surface;

indicating a locked state by having an unbiased rotatable handle movable to a first orientation;

indicating an unlocked state by having the unbiased rotatable handle moveable to a second orientation;

mounting a keypad to the unbiased rotatable handle;

providing a bolt on the planar, interior-facing surface of the closure member, the bolt movable between a retracted position and an extended position;

coupling the bolt to the unbiased rotatable handle such that the bolt moves linearly in response to any substantial movement of the unbiased rotatable handle;

providing a blocking device on the planar, interior-facing surface of the closure member;

preventing substantial movement of the bolt and the unbiased rotatable handle by moving the blocking device to a blocking position;

allowing substantial movement of the bolt and the unbiased rotatable handle by moving the blocking device to a non-blocking position;

biasing the blocking device to the blocking position, the blocking device only movable into the blocking position when the unbiased rotatable handle is in the first orientation; and producing a signal in response to a series of keypad inputs that corresponds to a predetermined combination, the blocking device moving from the blocking position to the non-blocking position in response to the signal from the controller;

providing the unbiased rotatable handle with a back having at least two curved mounting slots, each curved mounting slot having a cantilevered finger biased to extend into the slot and defining a large opening at an end of the slot; and attaching the unbiased rotatable handle to the door by passing a screw through the large opening and sliding the screw along the slot past the cantilevered finger, wherein the screw slides along the slot when the rotatable handle is moved between the first orientation and the second orientation for opening the closure member.

2. The method of claim 1, further comprising:

operably connecting a controller to the keypad and the blocking device, the controller producing the signal in response to the series of keypad inputs that corresponds to the predetermined combination.

3. The method of claim 1, further comprising:

coupling an electrical power source to the unbiased rotatable handle.

4. The method of claim 3, further comprising:

indicating a low power level condition of the electrical power source.

5. The method of claim 4, further comprising:

providing the rotatable handle with an indicator for indicating a lower power level condition of the electrical power source.

6. The method of claim 3, wherein the electrical power source is a battery.

7. The method of claim 1, further comprising:

defining the unbiased rotatable handle in a circular, ridged exterior; and defining the keypad with push buttons having alphanumeric and symbolic indicia.

8. The method of claim 1, further comprising:

providing the keypad with membrane covered contact switches.

9. The method of claim 1, further comprising:

providing the controller with a microprocessor.

10. The method of claim 1, further comprising:

providing the unbiased rotatable handle with polarized electrical contacts; and operably connecting the polarized electrical contacts to the controller.

11. The method of claim 1, wherein the closure member is a door.

12. A method of operating an electronic combination lock and an electronic keypad disposed on a face of the electronic combination lock, the method comprising:

providing a first assembly having a rotatable handle with the electronic keypad and an indicia disposed on a face of the rotatable handle, the rotatable handle being unbiased and movable between a first orientation wherein the indicia indicates that the lock is in a locked state and a second orientation wherein the indicia indicates that the lock is in an unlocked state;

disposing the first assembly on a planar, exterior-facing surface of a closure member such that the first assembly is accessible when the closure member is closed;

providing a second assembly having a locking mechanism including a bolt movable between a retracted position and an extended position, the bolt being unbiased and operably connected to the rotatable handle such that the bolt is moved in response to any substantial movement of the rotatable handle;

disposing the second assembly on a planar, interior-facing surface of the closure member such that the second assembly is inaccessible when the closure member is closed;

penetrating the closure member to couple the first assembly with the second assembly;

maintaining the rotatable handle in the first orientation by preventing substantial movement of the bolt until a predetermined combination is input through manipulation of the keypad; and allowing rotation of the rotatable handle whenever the rotatable handle is not in the first orientation.

13. The method of claim 12, wherein the coupling of the first assembly to the second assembly farther comprises:

connecting a first end of a shaft to the first assembly and connecting a second end of the shaft to the second assembly.

14. The method of claim 12, further comprising:

providing the rotatable handle with at least two curved mounting slots, each curved mounting slot having a cantilevered finger biased to extend into the slot and defining a large opening at an end of the slot; and attaching the rotatable handle to the closure member by passing a screw through the large opening and sliding the screw along the slot past the cantilevered finger, wherein the screw is slidingly coupled to the slot such that the screw slides along the slot when the rotatable handle is moved between the first orientation and the second orientation for opening the closure member.

15. The method of claim 12, further comprising:

allowing the rotatable handle to rotate about sixty degrees.

16. The method of claim 12, wherein the closure member is a door.

17. The method of claim 12, further comprising:

operably connecting a controller to the keypad, the controller producing the signal in response to the series of keypad inputs that corresponds to the predetermined combination.

18. The method of claim 12, further comprising:

coupling an electrical power source to the rotatable handle.

19. The method of claim 18, further comprising:

indicating a low power level condition of the electrical power source.

20. The method of claim 19, further comprising:

providing the rotatable handle with an indicator for indicating a lower power level condition of the electrical power source.

21. The method of claim 18, wherein the electrical power source is a battery.

22. The method of claim 12, further comprising:

defining the rotatable handle in a circular, ridged exterior; and defining the keypad with push buttons having alphanumeric and symbolic indicia.

23. The method of claim 12, further comprising:

providing the keypad with membrane covered contact switches.

24. A method of operating a combination lock mounted to a closure member, the method comprising:

mounting the combination lock to the closure member, wherein the closure member has a planar, exterior-facing surface and a planar, interior-facing surface;

indicating a locked state by having an unbiased rotatable handle movable to a first orientation;

indicating an unlocked state by having the unbiased rotatable handle movable to a second orientation;

mounting a keypad to the unbiased rotatable handle;

providing a bolt on the planar, interior-facing surface of the closure member, the bolt movable between a retracted position and an extended position;

connecting the unbiased rotatable handle to the bolt by a shaft;

containing a conductor within a substantially U-shaped channel of the shaft;

coupling the bolt to the unbiased rotatable handle such that the bolt moves linearly in response to any substantial movement of the unbiased rotatable handle;

providing a blocking device on the planar, interior-facing surface of the closure member;

preventing substantial movement of the bolt and the unbiased rotatable handle by moving the blocking device to a blocking position;

allowing substantial movement of the bolt and the unbiased rotatable handle by moving the blocking device to a non-blocking position;

biasing the blocking device to the blocking position, the blocking device only movable into the blocking position when the unbiased rotatable handle is in the first orientation; and producing a signal in response to a series of keypad inputs that corresponds to a determined combination, the blocking device moving from the blocking position to the non-blocking position in response to the signal from the controller.

25. The method of claim 24, further comprising:

operably connecting a controller to the keypad and the blocking device, the controller producing the signal in response to the series of keypad inputs that corresponds to the predetermined combination.

26. The method of claim 24, further comprising:

defining the unbiased rotatable handle in a circular, ridged exterior; and defining the keypad with push buttons having alphanumeric and symbolic indicia.

27. The method of claim 24, wherein the closure member is a door.

28. A method of operating a combination lock mounted to a closure member, the method comprising:

mounting the combination lock to the closure member, wherein the closure member has a planar, exterior-facing surface and a planar, interior-facing surface;

indicating a locked state by having an unbiased rotatable handle movable to a first orientation;

indicating an unlocked state by having the unbiased rotatable handle movable to a second orientation;

mounting a keypad to the unbiased rotatable handle;

providing a bolt on the planar, interior-facing surface of the closure member, the bolt movable between a retracted position and an extended position;

coupling the bolt to the unbiased rotatable handle such that the bolt moves linearly in response to any substantial movement of the unbiased rotatable handle;

providing a blocking device on the planar, interior-facing surface of the closure member, wherein the blocking device is a solenoid;

preventing substantial movement of the bolt and the unbiased rotatable handle by moving the blocking device to a blocking position;

allowing substantial movement of the bolt and the unbiased rotatable handle by moving the blocking device to a non-blocking position;

biasing the blocking device to the blocking position, the blocking device only movable into the blocking position when the unbiased rotatable handle is in the first orientation; and producing a signal in response to a series of keypad inputs that corresponds to a predetermined combination, the blocking device moving from the blocking position to the non-blocking position in response to the signal from the controller.

29. The method of claim 28, further comprising:

operably connecting a controller to the keypad and the blocking device, the controller producing the signal in response to the series of keypad inputs that corresponds to the predetermined combination.

30. The method of claim 28, further comprising:

coupling an electrical power source to the unbiased rotatable handle.

31. The method of claim 30, further comprising:

indicating a low power level condition of the electrical power source.

32. The method of claim 28, further comprising:

defining the unbiased rotatable handle in a circular, ridged exterior; and defining the keypad with push buttons having alphanumeric and symbolic indicia.

33. The method of claim 28, wherein the closure member is a door.

* * * * *